US011730260B2

(12) United States Patent
Tao et al.

(10) Patent No.: US 11,730,260 B2
(45) Date of Patent: Aug. 22, 2023

(54) DESKTOP LIFTING TABLE

(71) Applicant: NINGBO SOMLE AUDIO-VISUAL TECHNOLOGY CO., LTD, Ningbo (CN)

(72) Inventors: Liming Tao, Ningbo (CN); Haogang Wu, Ningbo (CN)

(73) Assignee: NINGBO SOMLE AUDIO-VISUAL TECHNOLOGY CO., LTD, Ningbo (CN)

( * ) Notice: Subject to any disclaimer, the term of this patent is extended or adjusted under 35 U.S.C. 154(b) by 0 days.

(21) Appl. No.: 17/365,310

(22) Filed: Jul. 1, 2021

(65) Prior Publication Data

US 2022/0330692 A1 Oct. 20, 2022

(30) Foreign Application Priority Data

Apr. 20, 2021 (CN) ..... 202120814591.1

(51) Int. Cl.
*A47B 9/16* (2006.01)
*A47B 21/02* (2006.01)

(52) U.S. Cl.
CPC ..... *A47B 9/16* (2013.01); *A47B 21/02* (2013.01); *A47B 2200/005* (2013.01)

(58) Field of Classification Search
CPC ..... A47B 1/03; A47B 21/0314; A47B 21/00; A47B 21/02; A47B 21/03; A47B 9/16; A47B 9/10; A47B 2021/0321; A47B 2021/0364; A47B 3/02; A47B 3/0809; A47B 3/0815; A47B 2003/025; A47B 3/00; A47B 61/00
USPC ..... 312/223.3; 248/421, 562, 588, 585, 431, 248/432, 439; 108/147, 144.11, 145, 93, 108/96, 116–118, 120, 43, 138, 50.01, 108/50.02
See application file for complete search history.

(56) References Cited

U.S. PATENT DOCUMENTS

| | | | | |
|---|---|---|---|---|
| 1,593,975 | A * | 7/1926 | Karstens | A47B 3/0912 108/132 |
| 5,284,100 | A * | 2/1994 | Thorn | A47B 3/0912 248/345.1 |
| 10,542,817 | B2 * | 1/2020 | Swartz | A47B 9/02 |
| 11,109,671 | B1 * | 9/2021 | Liu | A47B 9/02 |
| 11,134,773 | B1 * | 10/2021 | Poniatowski | A47B 21/04 |

(Continued)

FOREIGN PATENT DOCUMENTS

| | | | |
|---|---|---|---|
| CN | 102728962 | * | 4/2011 |
| CN | 106165968 | * | 11/2016 |
| CN | 206565534 | * | 10/2017 |

(Continued)

*Primary Examiner* — Janet M Wilkens
(74) *Attorney, Agent, or Firm* — Zhigang Ma

(57) ABSTRACT

The utility model belongs to the technical field of office and household articles, and particularly, relates to a desktop lifting table. The desktop lifting table includes a tabletop and a lifting mechanism that acts to raise or lower the tabletop, the first arm end of the lifting arm set is hingedly arranged and the second arm end thereof is slidably arranged; and a driving mechanism connected to the second arm end includes a gas spring, a gas spring seat and a manipulating member. The desktop lifting table of the utility model is provided with a gas spring seat below the tabletop to accommodate the gas spring so that its minimum height is very low.

10 Claims, 6 Drawing Sheets

(56) References Cited

U.S. PATENT DOCUMENTS

| | | | | |
|---|---|---|---|---|
| 2014/0041554 | A1* | 2/2014 | Huang | A47B 3/02<br>108/50.11 |
| 2016/0338486 | A1* | 11/2016 | Martin | A47B 9/16 |

FOREIGN PATENT DOCUMENTS

| | | | |
|---|---|---|---|
| JP | 2012030022 | * | 2/2012 |
| KR | 20110006306 | * | 6/2011 |
| WO | 2019001507 | * | 1/2019 |

* cited by examiner

DESKTOP LIFTING TABLE

FIELD OF THE INVENTION

The utility model belongs to the technical field of office and household articles, and particularly, relates to a desktop lifting table.

BACKGROUND OF THE INVENTION

After walking upright, humans found that sitting down is beneficial to relieve fatigue in daily activities, and thus invented seating furniture. This way of working in a sitting position has been passed down, but as people spend more and more time sitting at work, people gradually realized that sitting for a long time is not conducive to the improvement of working efficiency, so people began to try to sit and stand alternately at work. Gradually, lifting tables also appeared, and standing at work using the lifting tables has become a popular and healthy way of working.

However, due to the dimensional limitation of the existing desktop lifting tables, lifting mechanisms and driving mechanisms are unreasonably arranged, and it is also difficult to solve the problem of structural design with limited cost and product volume.

SUMMARY OF THE INVENTION

An object of the utility model is to provide a novel desktop lifting table which is provided with a reasonable mechanism and easy to manufacture and use.

To achieve the above object, the utility model employs the following scheme.

A desktop lifting table includes a tabletop and a lifting mechanism, wherein the tabletop is arranged above the lifting mechanism and the lifting mechanism acts to raise or lower the height of the tabletop, thus achieving the purpose of adjusting the height of the desktop lifting table. The lifting mechanism includes a lifting arm set that is hingedly connected at a middle part to realize a lifting function, the lifting arm set includes a first lifting arm and a second lifting arm, and middle parts of the first lifting arm and the second lifting arm hingedly cooperate to achieve the purpose of adjusting the lifting position through the rotation of the first lifting arm and the second lifting arm around a hinge point. The desktop lifting table also includes a driving mechanism which is connected to a second arm end to drive the second arm end to slide along a bottom surface of the tabletop and hence drive and control the rise/fall of the lifting arm set. The driving mechanism includes a gas spring, a gas spring seat and a manipulating member, wherein the gas spring seat is connected to the second arm end, and the gas spring has a fixing end connected to the gas spring seat and a manipulating end connected to the manipulating member.

According to the desktop lifting table, the gas spring seat includes a seat body that is strip-shaped, a mounting cavity is arranged in the seat body, and one end of the seat body is formed as a gas spring fixing end and the other end thereof is formed as a seat body fixing end; the fixing end of the gas spring is fixed at the gas spring fixing end and the manipulating end is connected to the manipulating member; and the seat body fixing end is connected to the second arm end so that the seat body is slidably fitted on the bottom surface of the tabletop along with the second arm end.

According to the desktop lifting table, the seat body preferably has a hollow columnar structure with a rectangular or circular section.

According to the desktop lifting table, the tabletop is rectangular with a length direction and a width direction, and two said lifting arm sets are arranged along the length direction and adjacently to edges of the tabletop, so that the lifting arm sets can well and stably support the tabletop and thus the tabletop is not easy to tip over. Hinge portions of the two lifting arm sets may be arranged in a penetrating or non-penetrating manner. The manipulating member is arranged on the bottom surface of the tabletop, and arranged along its edge to facilitate operation.

According to the novel desktop lifting table of the utility model, the lifting mechanism is arranged along the length direction of the tabletop and close to an edge of the tabletop to have extremely strong stability in the lifting process; moreover, in order to solve the problem of driving and locking of the sliding of the lifting arms at this time, the gas spring seat is arranged so that the lifting mechanism can also be effectively controlled even when the second arm end of the lifting mechanism is arranged close to an edge of the tabletop.

In addition, a tabletop supporting member is also arranged below the tabletop to solve the problem that the locking force is not strong due to excessive stress of the gas spring or the locking force at this time can be achieved only by a gas spring with better performance or larger size when the tabletop is lowered to a lower position, so that the desktop lifting table can meet its actual lifting requirements through a small gas spring, and can be adjusted to a very low minimum height.

DETAILED DESCRIPTION OF THE INVENTION

Figure 1:
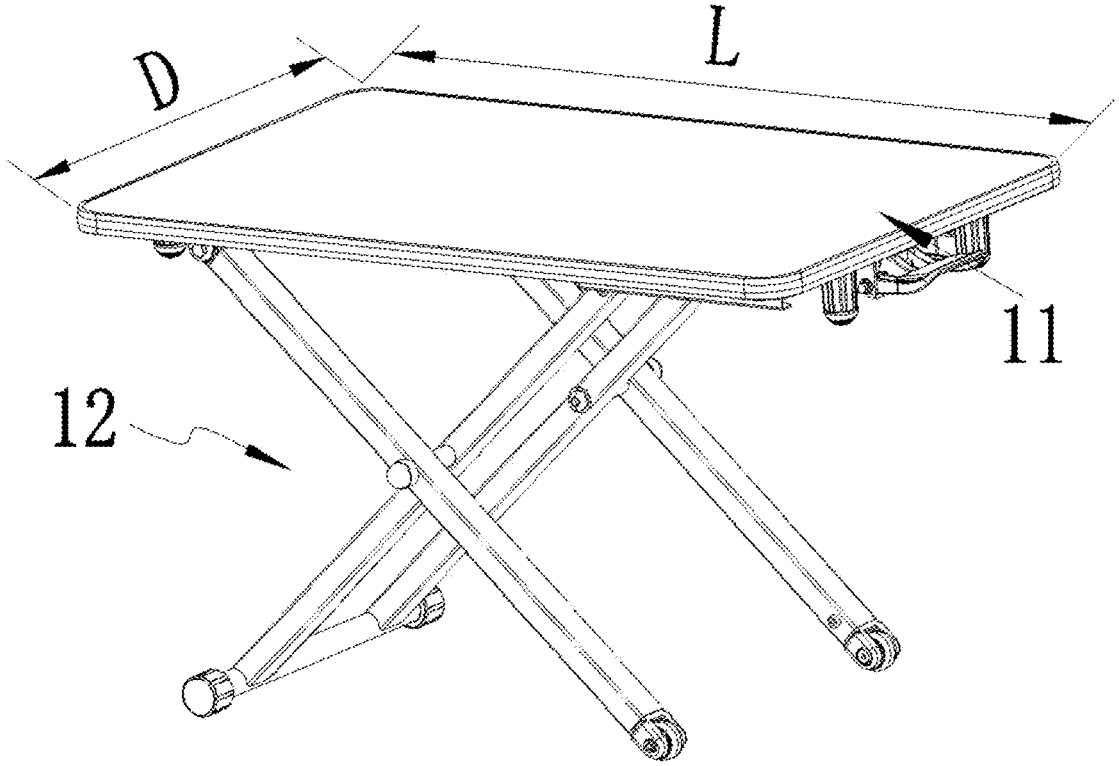
FIG. 1 is a schematic perspective structural view (in a top view) of a desktop lifting table of an embodiment of the utility model.
Figure 2:
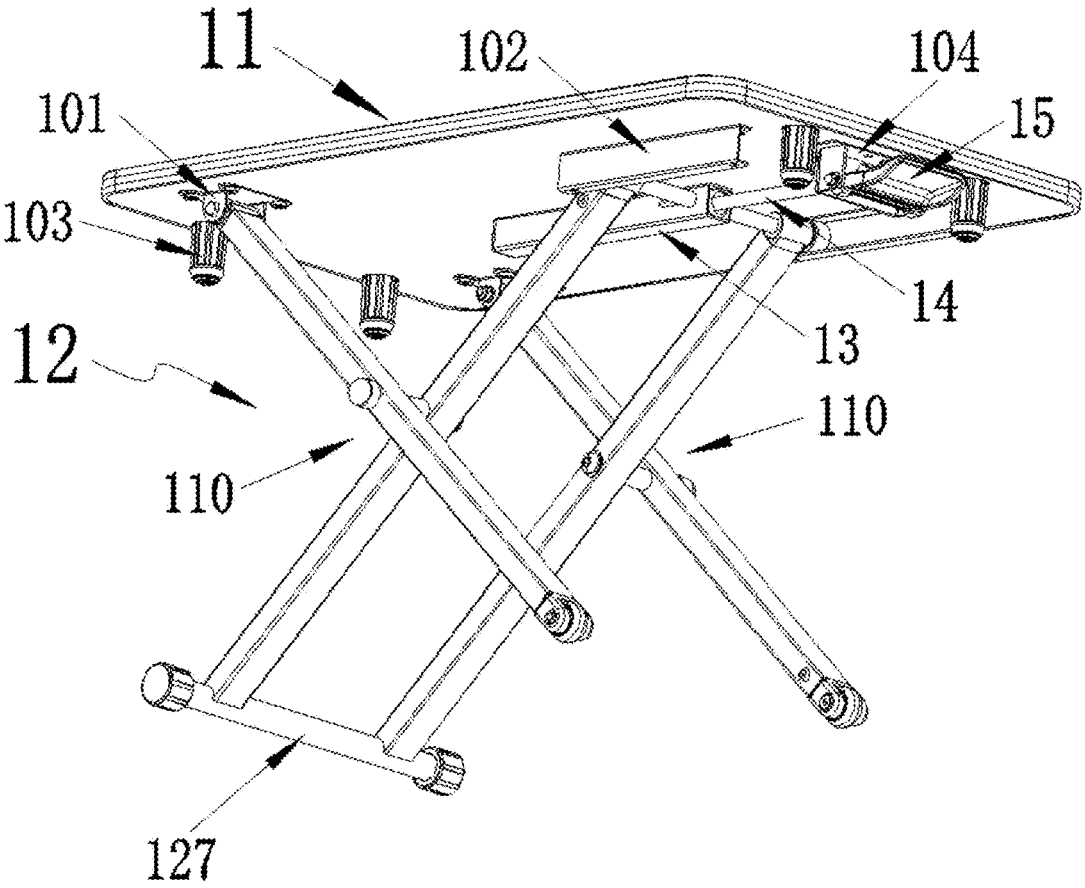
FIG. 2 is a schematic perspective structural view (in a bottom view) of the desktop lifting table of the embodiment of FIG. 1.

In order that those skilled in the art better understand the utility model to define the claimed scope of the utility model more clearly, the utility model will be described below in detail with reference to some particular embodiments of the utility model. It should be noted that the following description only refers to some particular embodiments within the concept of the utility model, which are only part of the embodiments of the utility model, wherein the detailed direct description of the related structures is only for the convenience of understanding the utility model, and various specific features do not certainly and directly define the implementation range of the utility model. Conventional selection and substitution made by those skilled in the art under the guidance of the concept of the utility model shall be considered to be within the claimed scope of the invention.

A desktop lifting table includes a tabletop 11 and a lifting mechanism 12, wherein a bottom surface of the tabletop 11 is connected to the top of the lifting mechanism 12, and the lifting mechanism 12 acts to raise or lower the height of the tabletop 11, so that the tabletop 11 has an adjustable working height.

An upper surface of the tabletop 11 is formed as a tabletop for supporting items such as a laptop computer and a display. The tabletop is generally flat, and may also include several tabletops with different heights. In addition, the tabletop 11 may also be additionally provided with a keyboard tray (not shown) for placing a keyboard, wherein the keyboard tray is generally arranged below an outer side of the tabletop 11, and can be fixed to the tabletop 11 through a metal connecting member, e.g. to the bottom surface of the tabletop 11.

The lifting mechanism 12 includes a lifting arm set 110 that is hingedly connected at a middle part to realize a lifting function. The lifting arm set 110 includes a first lifting arm 111 and a second lifting arm 112. Middle parts of the first lifting arm 111 and the second lifting arm 112 hingedly cooperate to form an X-shaped lifting arm set 110 rotatably arranged about a middle hinge shaft. When the lifting arm set 110 rotates around a hinge point at its middle part, ends of the two lifting arms 111, 112 are close to or far away from each other, and since their ends are respectively fitted on a supporting surface or the tabletop 11, thus further achieving the purpose of adjusting the height of the tabletop 11.

A first arm end 121, a second arm end 122, a third arm end 123 and a fourth arm end 124 are respectively formed at the ends of each of the first lifting arm 111 and the second lifting arm 112. The arm ends (121, 122, 123, 124) may be located at or near an end point of the first lifting arm 111 or the second lifting arm 112. The first arm end 121 and the second arm end 122 are directly or indirectly connected to the tabletop 11. The third arm end 123 and the fourth arm end 124 are placed on the supporting surface for placing the lifting table.

The first arm end 121 is hingedly fitted on the tabletop 11, for example, the first arm end is hingedly fitted on the bottom surface of the tabletop 11 through a hinge seat 101; the second arm end 122 is slidably arranged along the bottom surface of the tabletop 11; and the third arm end 123 and the fourth arm end 124 are placed on a base surface for providing a supporting force, e.g. an office tabletop, the ground or the like.

In some embodiments, the desktop lifting table also includes a sliding groove 102 fixedly arranged on the bottom surface of the tabletop 11. A pulley 129 is arranged at the second arm end 122 to be fitted into the sliding groove 102 so that the second arm end 122 is slidably fitted on the bottom surface of the tabletop 11. After being fitted into the sliding groove 102, the pulley 129 is limited in position by the sliding groove 102 to be only slidably arranged in the sliding groove 102.

A hinge line of the first arm end 121 is disposed coplanarly with a sliding center line of the second arm end 122, so that the tabletop can rise and fall smoothly. More preferably, the length of the first lifting arm 111 and the second lifting arm 112 above a middle hinge point is equal.

In other preferred embodiments, the desktop lifting table also includes a driving mechanism which is connected to the second arm end 122 to drive the second arm end 122 to slide along the bottom surface of the tabletop 11, thus driving and controlling the rise/fall of the lifting arm set 110.

The driving mechanism includes a gas spring 14, a gas spring seat 13 and a manipulating member 15, wherein the gas spring seat 13 is connected to the second arm end 122, the gas spring 14 has one end formed as its fixing end and the other end formed as a manipulating end, the fixing end of the gas spring 14 is connected to the gas spring seat 13, and its manipulating end is connected to the manipulating member 15. When the manipulating member 15 does not act on the manipulating end of the gas spring 14, the gas spring 14 is in a locked state and its length is constant; and when the manipulating member 15 acts on the manipulating end of the gas spring 14, the gas spring 14 returns to a retractable and movable state, and its overall length can be adjusted.

Since the manipulating member 15 is fixed on the bottom surface of the tabletop 11, the second arm end 122 of the lifting arm set 110 cannot slide when the length of the gas spring 14 is locked, thereby locking the rise and fall of the lifting arm set 110, i.e. locking the height of the desktop lifting table; and when the manipulating member 15 acts on the manipulating end of the gas spring 14 so that the gas spring is in a unlocked state, the gas spring 14 is extended or retracted under the action of an external force or its own storage capacity, the gas spring seat 13 slides along the bottom surface of the tabletop 11 along with the second arm end 122, so that the height of the desktop lifting table is raised or lowered.

In other preferred embodiments, the gas spring seat 13 includes a seat body 131 that is substantially strip-shaped as a whole, wherein the seat body 131 is provided with a mounting cavity 132 that is closed or substantially closed in space; and one end of the seat body 131 is formed as a gas spring fixing end 134, and the other end thereof is formed as a seat body fixing end 133. One end of the gas spring 14 is fixed to the gas spring fixing end 134, and the other end thereof is connected to the manipulating member 15. The seat body fixing end 133 is connected to the second arm end 122 of the lifting arm set 100, so that the seat body 131 is slidably fitted on the bottom surface of the tabletop 11 along with the second arm end 122.

Figure 7:
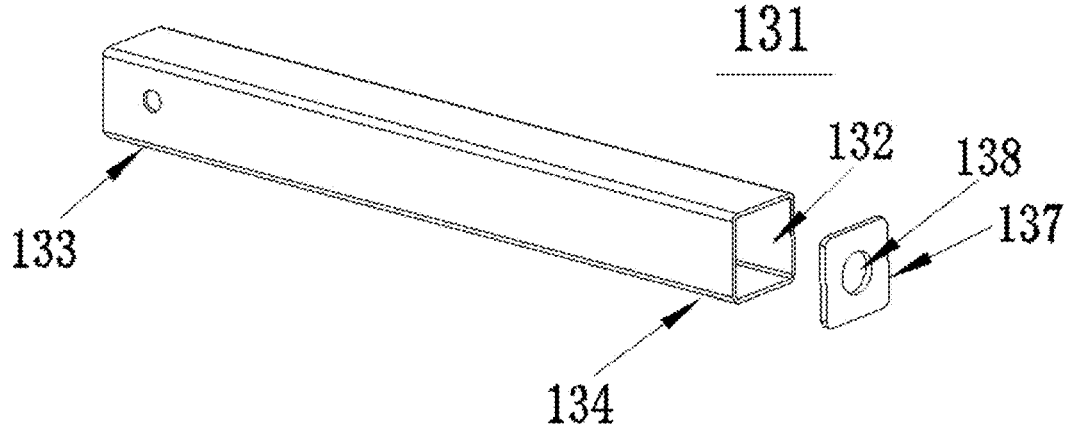
FIG. 7 is a schematic structural exploded view of a seat body 131 of the embodiment of FIG. 5.

For example, as shown in FIG. 7, in some embodiments, the gas spring seat 13 has a hollow tubular structure with a rectangular section, the mounting cavity 132 is formed by its inner cavity, both ends of the hollow tubular structure are respectively formed as the seat body fixing end 133 and the gas spring fixing end 134, an end block 137 fixedly connected by means of welding or the like is arranged at the gas spring fixing end 134, and the end block 137 is provided with a gas spring mounting hole 138 for connecting the fixing end of the gas spring 14 thereto. Although the gas spring seat 13 having a hollow tubular structure with a rectangular section is shown, it is not just this case. In the case of a hollow tubular shape as a whole, its section can also be circular, elliptical or the like, as long as its inner cavity can accommodate the gas spring 14.

Figure 11:
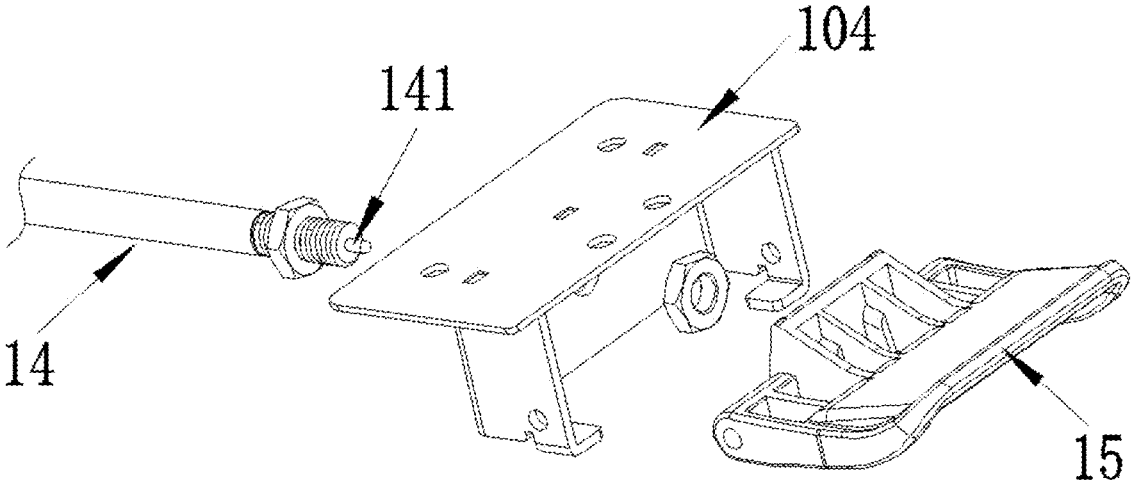
FIG. 11 is a schematic exploded view showing cooperation between a gas spring 14 and a manipulating member fixing seat 104 and a manipulating member 15 in the embodiment of FIG. 1.
Figure 12:
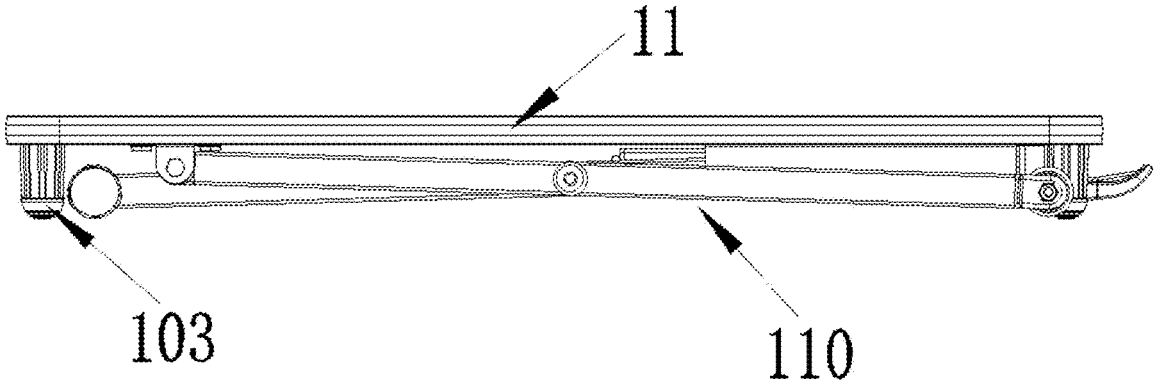
FIG. 12 is a front view of the desktop lifting table of the embodiment of FIG. 1 when raised to a minimum height.
Figure 13:
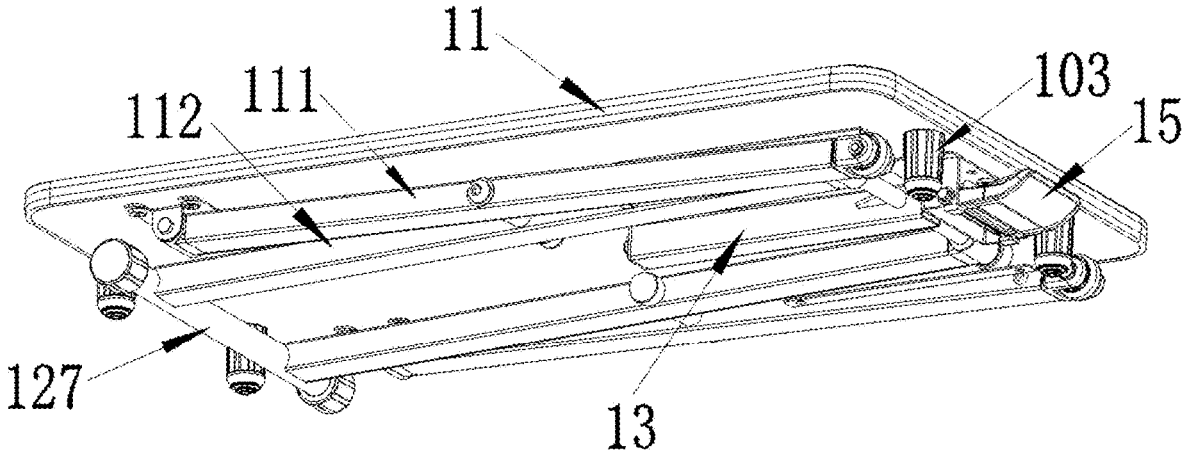
FIG. 13 is a schematic perspective structural view (in a bottom view) of the desktop lifting table of FIG. 12.

In order to fix the manipulating member 15, the desktop lifting table also includes a manipulating member fixing seat 104, the manipulating member 15 is fixed on the manipulating member fixing seat 104; and the manipulating end of the gas spring 14 is also fixed on the manipulating member fixing seat 104, an unlocking member of the gas spring 14 is arranged at its manipulating end, and the unlocking member passes through the manipulating member fixing seat 104 and then cooperates with the manipulating member 15. After being operated, the manipulating member 15 acts on the unlocking member of the gas spring 14 to unlock the gas spring 14, so that the gas spring can be extended or retracted under the action of an external force or the like. For example, as shown in FIG. 11, the manipulating end of the gas spring 14 is fixed on the fixing seat 104 by a nut, and the manipulating member 15 is pivotally arranged on the fixing seat 104, so that the manipulating member 15 can act on an operating portion 141 of the gas spring 14 to unlock the gas spring 14.

Figure 9A:
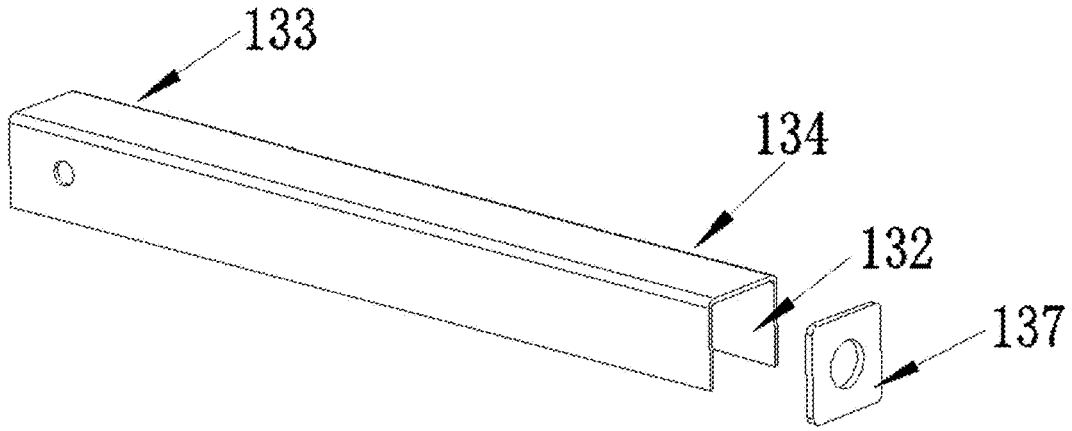
FIGS. 9*a* and 9*b* are schematic structural exploded views of a seat body 131 of other embodiments.
Figure 9B:
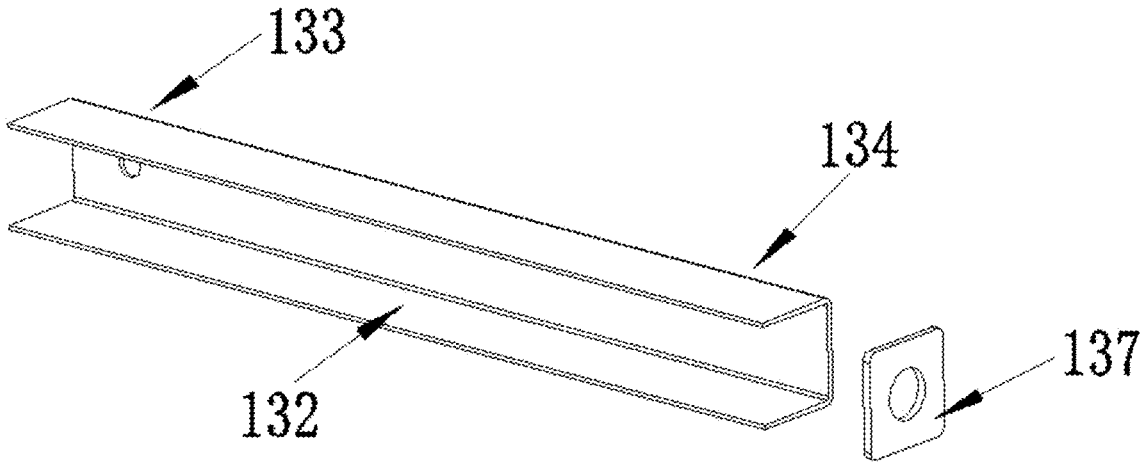

In other embodiments, the gas spring seat 13 changes from the above substantially closed structure to a partially open structure. For example, in the embodiment shown in FIGS. 9*a* and 9*b*, the gas spring seat 13 is consistent as a whole with that shown in FIG. 7, except that an open gas spring seat 13 is formed due to lack of one side as compared to the embodiment of FIG. 7; and meanwhile, the gas spring seat 13 of this shape can be mounted in different directions, so that the two specific implementation states shown in FIGS. 9*a* and 9*b* can be formed.

Figure 10:
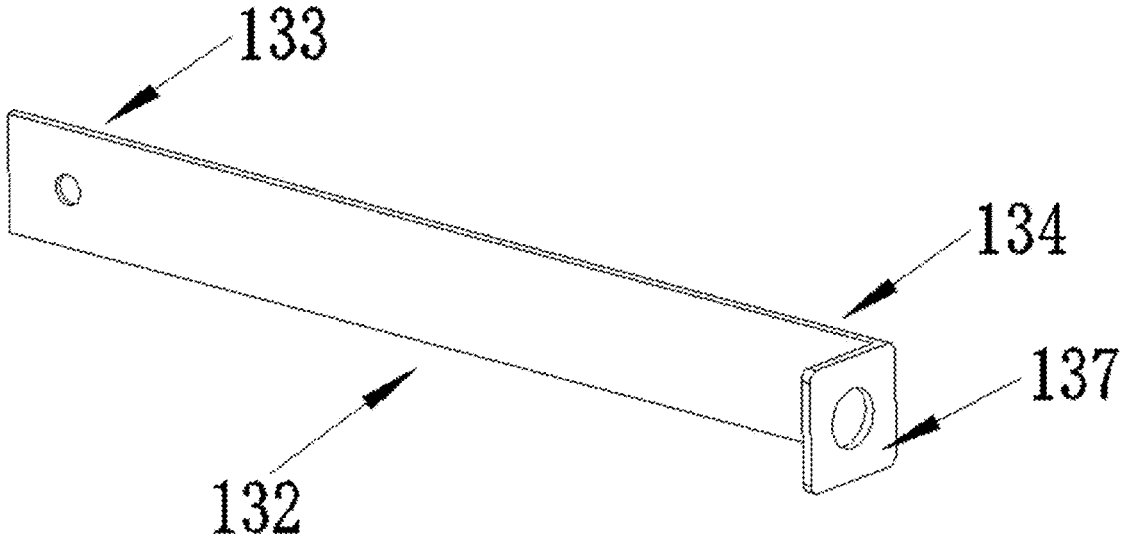
FIG. 10 is a schematic structural view of a seat body 131 of another embodiment.

For another example, in the embodiment shown in FIG. 10, the gas spring 13 in the embodiment of FIG. 7 is further structurally adjusted to be L-shaped as a whole, i.e. a strip-shaped component is bent at its end to form the end block 137.

There are two possible ways to connect the gas spring seat 13 to the second arm end 122.

Figure 6:
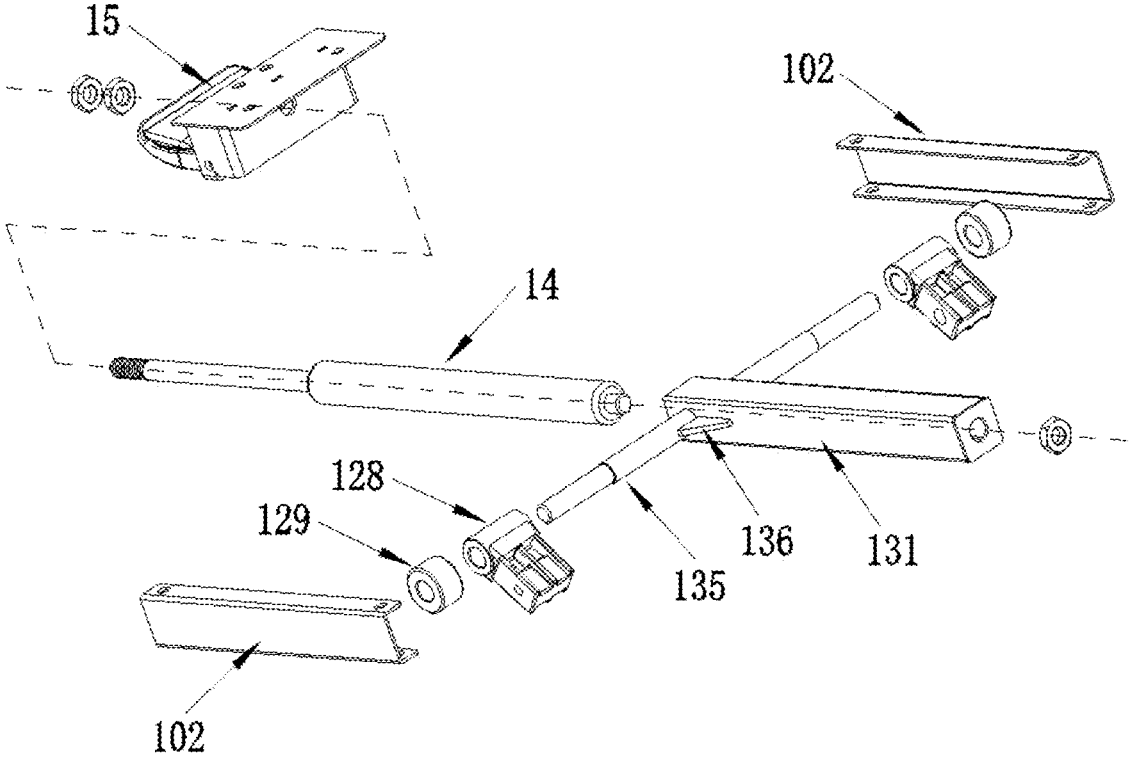
FIG. 6 is a schematic structural exploded view of the driving mechanism of FIG. 5.

Firstly, as shown in FIG. 6, the second arm ends 122 of the two lifting arm sets 110 are respectively connected to the seat body fixing end 133 of the gas spring seat 13 by connecting members 135. Most preferably, the gas spring seat 13 is located in the middle of the two second arm ends 122, i.e. the two connecting members 135 are equal in length. In order to enhance the connection stability between the connecting members 135 and the seat body fixing end 133, a triangular connection stabilizing block 136 is also arranged on an outer side of the gas spring seat 13 to ensure that the connecting members 135 are firmly connected to the seat body fixing end 133.

Figure 8:
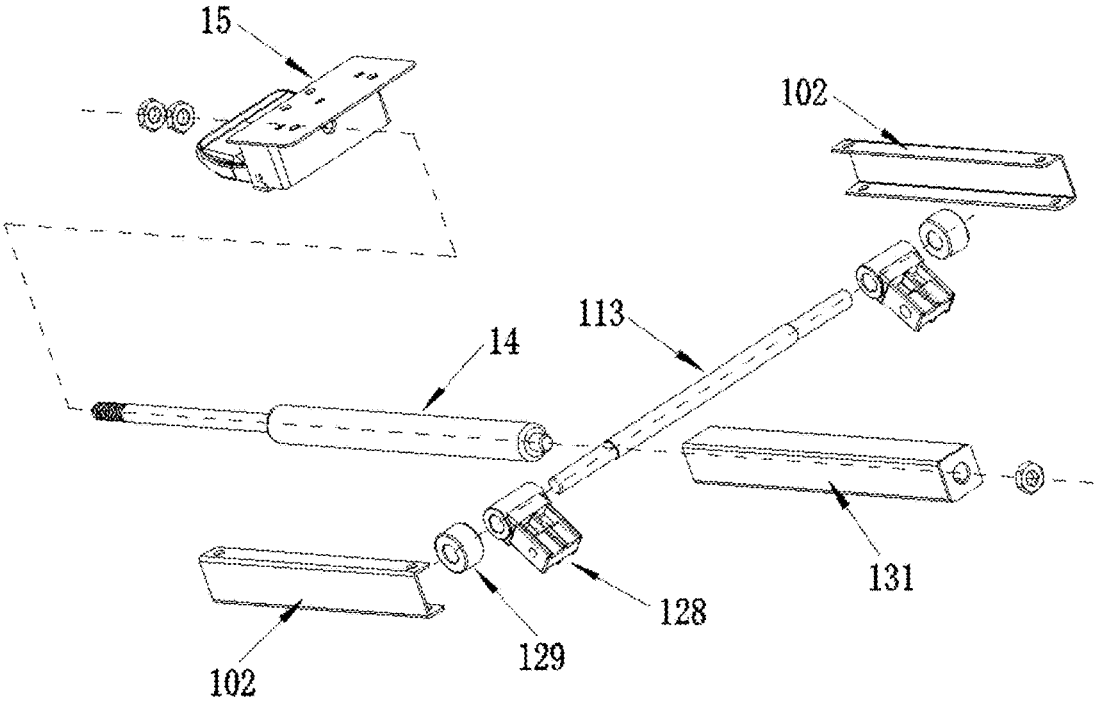
FIG. 8 is a schematic structural exploded view of a driving mechanism of another embodiment.

Secondly, since the fourth arm ends 124 at lower ends of the two second lifting arms 112 are fixedly connected by a leg link 127, the second arm ends 122 at upper ends of the two second lifting arms 112 may slide synchronously, but in order to further improve the stability of the desktop lifting table, as shown in FIG. 8, a slide link 113 is arranged between the two second arm ends 122, and both ends of the slide link 113 are respectively fitted on the two second arm ends 122 of the two second lifting arms 112, so that the second arm ends 122 slide in strict synchronization. At this time, the seat body fixing end 133 of the gas spring seat 13 is fixed to any position on the slide link 113, preferably also the middle position.

In the above two embodiments, in order to connect the connecting member 135 or the slide link 113 to the second arm end 122, a pivoting member 128 is arranged at the second arm end 122 and provided with a through hole for the connecting member 135 or the slide link 113 to penetrate through; and a pulley 129 is also arranged, and an end of the connecting member 135 or the slide link 113 is penetrating through the through hole of the pivoting member 128 and then fitted on the pulley 129, so that the second arm end 122 is slidably fitted in the sliding groove 102 through the pivoting member 128, the connecting member 135 (the slide link 113) and the pulley 129, thus achieving the purpose of slidingly fitting the second arm end 122 on the bottom surface of the tabletop 11.

In some embodiments, the tabletop 11 is rectangular with a length direction L and a width direction D, and two said lifting arm sets 110 are arranged along the length direction L and adjacently to edges of the tabletop 11; and when the desktop lifting table rises or falls, the first lifting arm 111 and the second lifting arm 112 at the upper end of each lifting arm set 110 are close to the edges of the tabletop 11, so that the lifting arm sets 110 can well and stably support the tabletop 11 and thus the tabletop is not easy to tip over.

The manipulating member 15 is arranged on the bottom surface of the tabletop 11, and arranged along the edge in the width direction D to facilitate operation.

Figure 3:
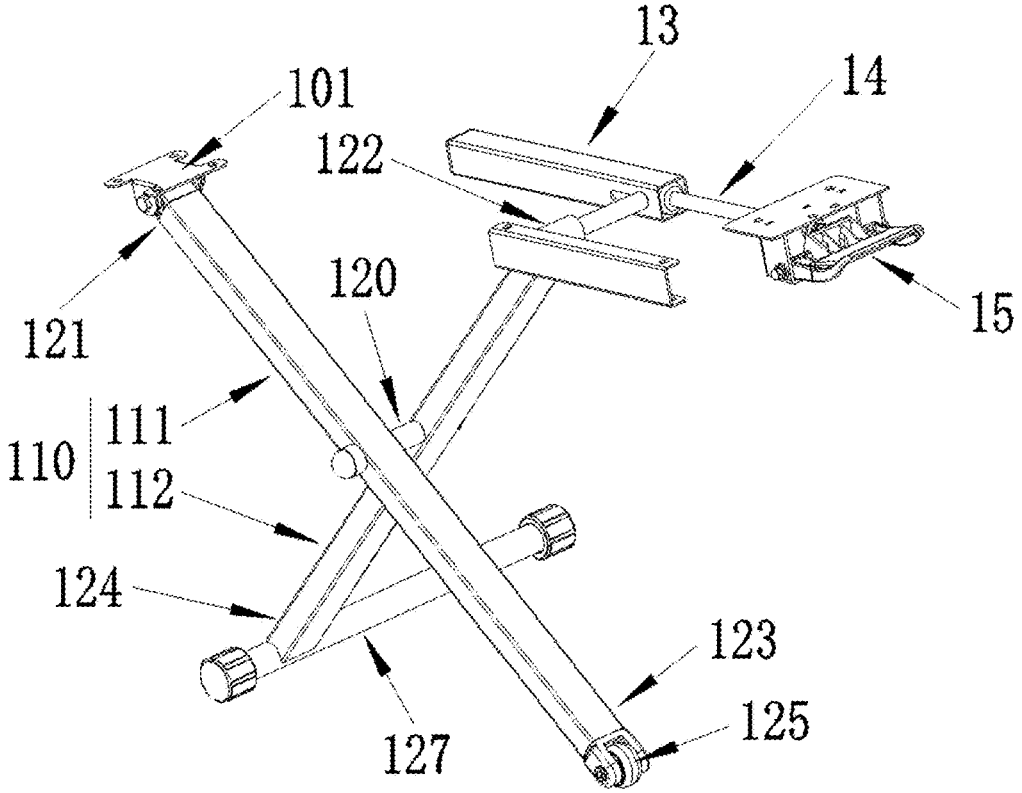
FIG. 3 is a schematic structural view of a lifting mechanism of the desktop lifting table of the embodiment of FIG. 1.
Figure 4:
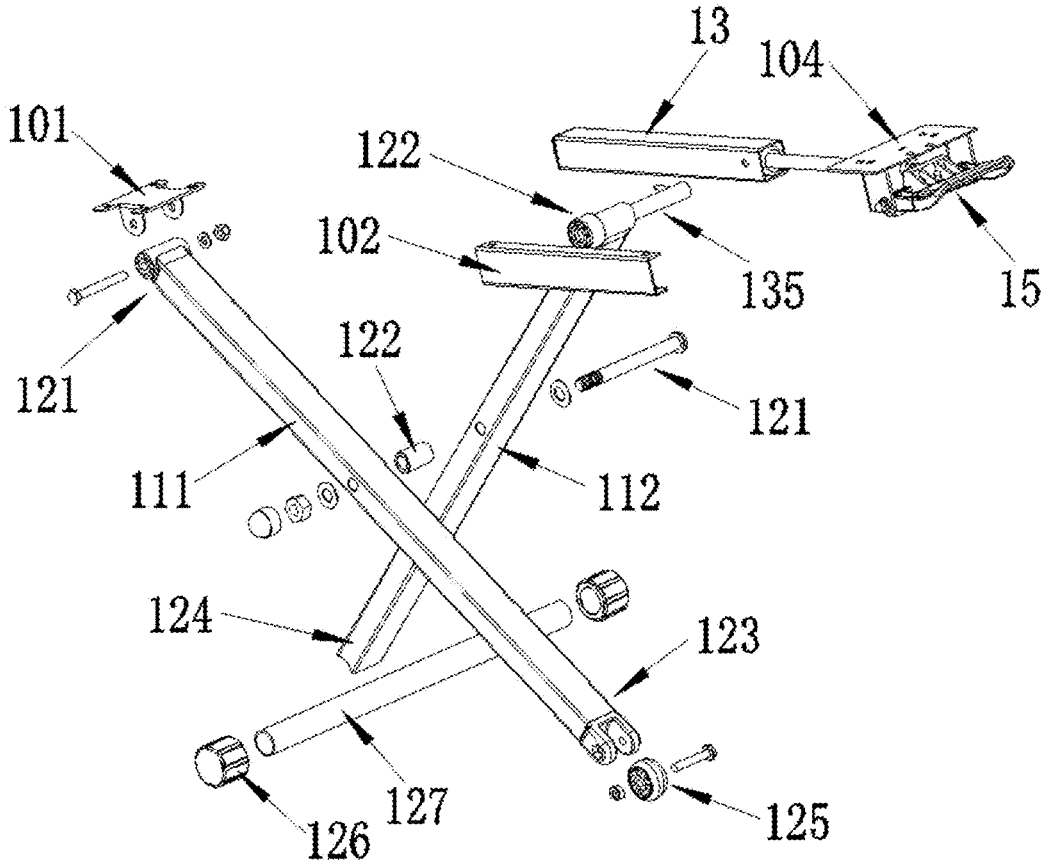
FIG. 4 is a schematic structural exploded view of FIG. 3.
Figure 5:
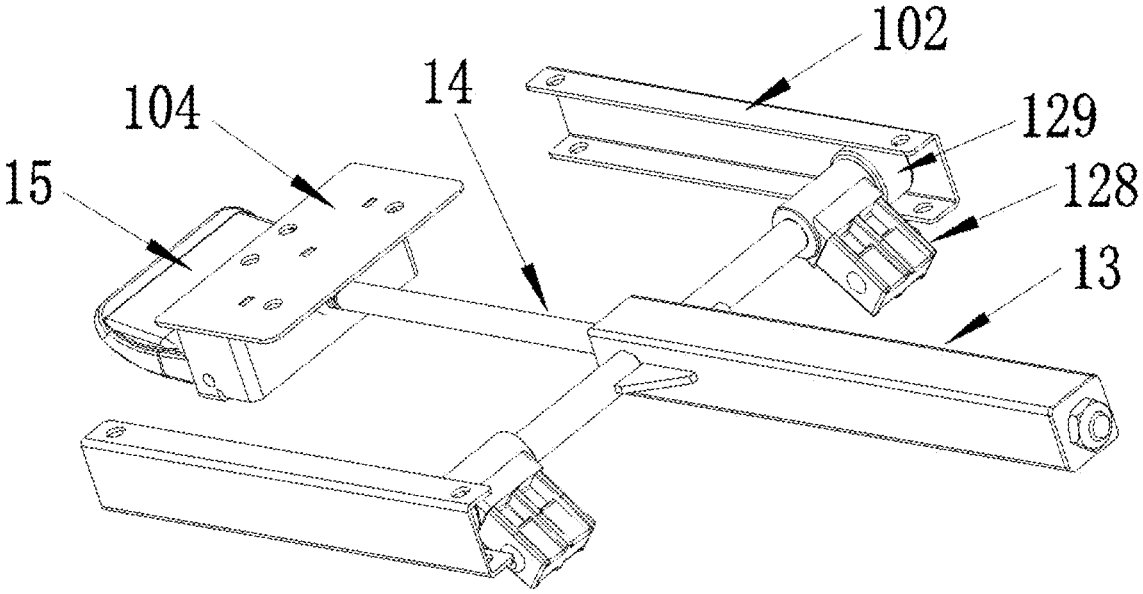
FIG. 5 is a schematic structural view of a driving mechanism of the desktop lifting table of the embodiment of FIG. 1.

Hinge portions in the middle of two said lifting arm sets 110 may be either penetrating or non-penetrating; i.e. the two lifting arm sets 110 may be penetrated by the same hinge shaft so that the two lifting arm sets 110 are hingedly arranged to form the above middle part, or, as shown in FIG. 1, the two lifting arm sets 110 are hingedly connected by different hinges. For example, as shown in FIGS. 3 and 4, the middle parts of the first lifting arm 111 and the second lifting arm 112 are penetrated by a hinge 120 to be hingedly arranged. The hinge 120 includes a hinge shaft 1201, a gap sleeve 1202, and several washers and nuts.

Preferably, a hinge line of the first arm end 121 is disposed coplanarly with a sliding center line of the second arm end 122, so that the tabletop 11 remains stable in the lifting adjustment of the desktop lifting table.

More preferably, the length of the first lifting arm 111 and the second lifting arm 112 above a middle hinge point is equal.

In other embodiments, the lifting mechanism 12 also includes a leg link 127 which is connected to lower ends of the corresponding lifting arms of the two lifting arm sets 110, i.e. to the fourth arm ends 124 at the lower ends of the second lifting arms 112 of the two lifting arm sets 110. Among the two lifting arm sets 110, although the first lifting arm 111 and the second lifting arm 112 can be rotatably arranged relative to each other through hinging at the middle parts, since the second arm end 122 at the upper end of the second lifting arm 112 is slidably fitted on the bottom surface of the tabletop 11, in order that the second arm end 122 slides relatively smoothly with the bottom surface of the tabletop 11, the fourth arm ends 124 at the other respective ends of the hinge points of the two lifting arm sets are rigidly connected together by the leg link 127, so that the second arm ends 122 at the upper ends of the two second lifting arms 112 can slide synchronously to ensure a smooth rising or falling process. Most preferably, the leg link 127 is also provided with a supporting leg member 126 made of a soft material, wherein the supporting leg member 126 can increase the friction between the desktop lifting table and the supporting surface on the one hand, and can also properly improve the placement stability caused by the uneven supporting surface on the other hand.

In some other embodiments, the lifting mechanism 12 also includes rollers 125 which are arranged at the lower ends of the corresponding lifting arms of the two lifting arm sets 110, i.e. at the third arm ends 123 at the lower ends of the two first lifting arms 111. Since in the lifting adjustment of the desktop lifting table, the first arm end 121 and the fourth arm end 124 do not move relative to each other, the lifting process is realized by the translational sliding of the second arm end 122 and the third arm end 123; and the rollers 125 are arranged at the third arm ends 123 to ensure that a lower end of the lifting mechanism is always in contact with the supporting surface in the lifting process of the desktop lifting table, and the lifting process is stable.

In other embodiments, the desktop lifting table also includes a tabletop supporting member 103 which is arranged on the bottom surface of the tabletop 11 to define the minimum height of the tabletop 11; and four said tabletop supporting members 103 are arranged and located on an outer side of the lifting mechanism. When the lifting mechanism 12 acts to the lowest position, due to the limitation of the structure principle, the gas spring 14 is to receive a very huge force when the lifting mechanism 12 is in its lowest working position. At this time, if the second arm end 122 is to be locked by the gas spring 14, the gas spring 14 needs to have very high performance or a larger volume, which is disadvantageous for cost and mounting space. Therefore, the tabletop supporting members 103 are added to replace the gas spring 14 to support the tabletop 11, so that the force of the tabletop 11 is directly acted on the supporting surface by the tabletop supporting members 103. Accordingly, in the desktop lifting table, the lifting control and locking in the lifting space can be completed without a particularly powerful gas spring 14.

In some other embodiments, the desktop lifting table may further include a base which is preferably rectangular or approximately rectangular; in this case, the fourth arm ends 124 of the two lifting arm sets 110 are hingedly arranged on the base, and similar to the first arm end 121, the third arm end 123 is slidably fitted on the base, which can be achieved by a sliding groove correspondingly arranged on the base. At this time, when the height of the desktop lifting table is raised and lowered, the first and fourth arm ends rotate, and the second and third arm ends slide horizontally, so that the distance between the tabletop and the base is reduced or increased, thus achieving the purpose of lifting adjustment and control of the desktop lifting table.

The invention claimed is:

1. A desktop lifting table, comprising:

a tabletop, and a lifting mechanism, wherein the tabletop is arranged above the lifting mechanism and the lifting mechanism acts to raise or lower the tabletop;

the lifting mechanism includes a lifting arm set that is hingedly connected at a middle part to realize a lifting function, the lifting arm set includes a first lifting arm and a second lifting arm, and middle parts of the first lifting arm and the second lifting arm hingedly cooperate to adjust the lifting position through the rotation of the first lifting arm and the second lifting arm around a hinge point; and a first arm end, a second arm end, a third arm end and a fourth arm end are respectively formed at ends of each of the first lifting arm and the second lifting arm, the first arm end is hingedly fitted on the tabletop, and the second arm end is slidably arranged along a bottom surface of the tabletop;

the desktop lifting table also includes a driving mechanism which is connected to the second arm end to drive the second arm end to slide along the bottom surface of the tabletop and hence drive and control the rise/fall of the lifting arm set; and the driving mechanism includes a gas spring, a gas spring seat and a manipulating member, the gas spring seat is connected to the second arm end, and the gas spring has a fixing end connected to the gas spring seat and a manipulating end connected to the manipulating member;

two said lifting arm sets are arranged; the second arm ends of the two lifting arm sets are respectively connected to the gas spring seat by connecting members, a pivoting member is arranged at the second arm end and provided with a through hole for the connecting member to penetrate through; and a pulley is also arranged at the second arm end, and an end of the connecting member is penetrating through the through hole of the pivoting member and then fitted on the pulley.

2. The desktop lifting table according to claim 1, wherein the gas spring seat includes a seat body that is strip-shaped, a mounting cavity is arranged in the seat body, and one end of the seat body is formed as a gas spring fixing end and the other end thereof is formed as a seat body fixing end; the fixing end of the gas spring is fixed at the gas spring fixing end and the manipulating end is connected to the manipulating member; and the seat body fixing end is connected to the second arm end so that the seat body is slidably fitted on the bottom surface of the tabletop along with the second arm end.

3. The desktop lifting table according to claim 2, wherein the seat body has a hollow columnar structure with a rectangular or circular section.

4. The desktop lifting table according to claim 3, wherein the second arm ends of the two lifting arm sets are respectively connected to the seat body fixing end of the gas spring seat by connecting members; and the two connecting members are equal in length, and a triangular connection stabilizing block is arranged on an outer side of the gas spring seat.

5. The desktop lifting table according to claim 4, wherein the tabletop is rectangular with a length direction and a width direction, and two said lifting arm sets are arranged along the length direction and adjacently to edges of the tabletop; hinge portions of the two lifting arm sets are arranged in a non-penetrating manner; and the manipulating member is arranged on the bottom surface of the tabletop, and arranged along its edge to facilitate operation.

6. The desktop lifting table according to claim 5, wherein the desktop lifting table also includes a sliding groove which is fixedly arranged on the bottom surface of the tabletop; a pulley is arranged at the second arm end to be fitted into the sliding groove so that the second arm end is slidably fitted on the bottom surface of the tabletop; and a hinge line of the first arm end is disposed coplanarly with a sliding center line of the second arm end, so that the tabletop can rise and fall smoothly.

7. The desktop lifting table according to claim 6, wherein the lifting mechanism also includes a leg link which is connected to the fourth arm ends of the two lifting arm sets; and the leg link is also provided with a supporting leg member made of a soft material; and the lifting mechanism also includes rollers which are arranged at the third arm ends of the two lifting arm sets.

8. The desktop lifting table according to claim 3, wherein a slide link is arranged between the two second arm ends, and both ends of the slide link are respectively fitted at the two second arm ends of the two second lifting arms.

9. The desktop lifting table according to claim 2, wherein the seat body is a semi-closed seat body with an opening formed on a side wall thereof, or the seat body is an open seat body.

10. The desktop lifting table according to claim 1, wherein the desktop lifting table also includes a tabletop supporting member which is arranged on the bottom surface of the tabletop to define the minimum height of the tabletop.

* * * * *